US010306915B2

(12) United States Patent
Kotrola et al.

(10) Patent No.: US 10,306,915 B2
(45) Date of Patent: Jun. 4, 2019

(54) PEROXIDES TO LIMIT BIOFILMS AND TOBACCO-SPECIFIC NITROSAMINES

(71) Applicant: Altria Client Services LLC, Richmond, VA (US)

(72) Inventors: John Kotrola, Williamsburg, VA (US); Ujwala Warek, Chester, VA (US); James Arthur Strickland, Richmond, VA (US); Elisabeth Miller, Chesterfield, VA (US); Dongmei Xu, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 1347 days.

(21) Appl. No.: 14/263,530

(22) Filed: Apr. 28, 2014

(65) Prior Publication Data

US 2015/0305399 A1 Oct. 29, 2015

(51) Int. Cl.

| | |
|---|---|
| ***A24B 3/14*** | (2006.01) |
| ***A24B 15/12*** | (2006.01) |
| ***A24B 15/28*** | (2006.01) |

(52) U.S. Cl.

CPC ..... *A24B 15/12* (2013.01); *A24B 3/14* (2013.01); *A24B 15/287* (2013.01)

(58) Field of Classification Search

None

See application file for complete search history.

(56) References Cited

U.S. PATENT DOCUMENTS

| | | | | |
|---|---|---|---|---|
| 3,020,179 | A * | 2/1962 | Hess | A24B 15/12 131/355 |
| 4,366,824 | A | 1/1983 | Rainer et al. | |
| 5,118,389 | A * | 6/1992 | Dubelsten | D21C 9/163 162/123 |
| 6,755,200 | B1 | 6/2004 | Hempfling et al. | |
| 2008/0209586 | A1 | 8/2008 | Nielsen et al. | |

FOREIGN PATENT DOCUMENTS

| | | |
|---|---|---|
| GB | 832 991 | 4/1960 |

OTHER PUBLICATIONS

International Search Report and Written Opinion in International Application No. PCT/US2014/035709, dated Jul. 1, 2014.

Bush et al., "Formation of Tobacco-Specific Nitrosamines in Air-Cured Tobacco," *Recent Advanced in Tobacco Science*, 2001, 27:23-46.

International Preliminary Report on Patentability in International Application No. PCT/US2014/035709, dated Nov. 1, 2016, 7 pages.

* cited by examiner

*Primary Examiner* — Michael J Felton

(74) *Attorney, Agent, or Firm* — Harness, Dickey & Pierce, P.L.C.

(57) ABSTRACT

Methods of making reconstituted tobacco include contacting a mixture including tobacco pulp with one or more fluid streams including one or more peroxides (e.g., hydrogen peroxide), recovering one or more fluids from the tobacco pulp mixture, and reusing the recovered fluids in at least one subsequent tobacco pulp contacting step. In some cases, methods provided herein can recover one or more fluids including one or more peroxides, such that the at least one subsequent tobacco pulp contacting step includes contacting tobacco pulp with a fluid including one or more peroxides.

9 Claims, 2 Drawing Sheets

PEROXIDES TO LIMIT BIOFILMS AND TOBACCO-SPECIFIC NITROSAMINES

FIELD

This disclosure generally relates to the use of peroxides (e.g., hydrogen peroxide) to limit the formation of biofilms and tobacco-specific nitrosamines (TSNAs).

BACKGROUND

During the processing and manufacturing of tobacco products, tobacco by-products such as tobacco stems, leaf scraps, and tobacco dust produced during the manufacturing process (i.e., stemming, aging, blending, cutting, drying, cooling, screening, shaping and packaging) can be recycled to reclaim useful tobacco content. In the past, such tobacco by-products have been formed into what is known in the industry as reconstituted tobacco sheets. In the manufacturing of smoking articles and particularly cigarettes, it is common to use sheets of reconstituted tobacco. In some cases, reconstituted tobacco sheets can be used as a wrapper. In some cases, reconstituted tobacco sheets can be cut into strips and blended with tobacco. In some cases, tobacco pulp is suspended, cast, and dried to form a sheet of reconstituted tobacco. In some cases, processes for manufacturing reconstituted tobacco sheets use a machine in which water is drained from a fibrous slurry of tobacco particles, and sheet that is formed is subsequently treated and dried.

SUMMARY

Methods of making reconstituted tobacco provided herein can include contacting a mixture including tobacco pulp with one or more fluid stream including one or more peroxides (e.g., hydrogen peroxide), recovering one or more fluids from the tobacco pulp mixture, and reusing the recovered fluids in at least one subsequent tobacco pulp contacting step. In some cases, methods provided herein can recover one or more fluids including one or more peroxides, such that the at least one subsequent tobacco pulp contacting step includes contacting tobacco pulp with a fluid including one or more peroxides. In some cases, the one or more fluid streams have a peroxide concentration of at least 60 ppm. In some cases, the one or more fluid streams have a peroxide concentration of at least 100 ppm, at least 200 ppm, at least 300 ppm, at least 400 ppm, or at least 500 ppm. In some cases, a peroxide concentration in the recovered fluid used in the at least one subsequent tobacco pulp contacting step is within plus or minus 50% of the peroxide concentration of the one or more fluid streams. In some cases, the recovered fluids can be supplemented with fresh fluids and/or one or more fresh peroxides prior to the at least one subsequent tobacco pulp contacting step in order to maintain a desired hydrogen peroxide concentration.

Methods of making reconstituted tobacco provided herein can, in some cases, recycle aqueous fluid streams contacting tobacco pulp in order to produce a recycled aqueous solution of soluble tobacco components. In some cases, methods provided herein can include one or more peroxides (e.g., hydrogen peroxide) in the recycled aqueous solution. In some cases, the recycled aqueous solution is treated between subsequent tobacco pulp contacting steps to maintain a desired peroxide concentration. In some cases, the recycled aqueous solution is maintained at a peroxide concentration of at least 60 ppm, at least 100 ppm, at least 200 ppm, at least 300 ppm, at least 400 ppm, or at least 500 ppm.

Methods of making reconstituted tobacco provided herein can, in some cases, agitate tobacco by-products with an aqueous pulping fluid in order to form a tobacco pulp suspension. In some cases, methods provided herein can include one or more peroxides (e.g., hydrogen peroxide) in the aqueous pulping fluid. The tobacco pulp suspension can be separated into a tobacco pulp mixture and a liquid extract. In some cases, the liquid extract can include one or more peroxides. In some cases, the liquid extract can be concentrated and applied to a cast sheet of tobacco pulp. In some cases, the liquid extract can be treated to have nitrates removed and applied to a sheet of tobacco pulp. In some cases, the liquid extract can be maintained at a desired peroxide concentration during storage after separation from the tobacco pulp and prior to application to a sheet of tobacco pulp. In some cases, the stored liquid extract is maintained at a peroxide concentration of at least 60 ppm, at least 100 ppm, at least 200 ppm, at least 300 ppm, at least 400 ppm, or at least 500 ppm.

In some cases, methods provided herein can inhibit the growth of biofilm producing bacteria, such as *Geobacillus stearothermophilus*, in one or more fluid streams used to produce a reconstituted tobacco. For example, systems including recycled streams without the addition of peroxides can have a population of *Geobacillus stearothermophilus* of about 10,000 cfl/ml, which can produce a significant amount of biofilm in the system. In some cases, methods provided herein can control a population of a biofilm producing bacteria below a desired threshold. In some cases, a population of *Geobacillus stearothermophilus* in methods and systems provided herein can be maintained below a threshold of 5,000 clf/ml; below a threshold of 1,000 cfl/ml; below a threshold of 500 cfl/ml; below a threshold of 100 cfl/ml; below a threshold of 50 cfl/ml; below a threshold of 20 cfl/ml; below a threshold of 10 cfl/ml; or below a threshold of 5 cfl/ml. In some cases, a population of a biofilm producing bacteria, such as *Geobacillus stearothermophilus*, can be maintained below a detectable limit. For example, biofilm producing bacteria can proliferate in one or more streams used in traditional methods of reconstituting tobacco, especially recycled streams. Biofilm producing bacteria can produce a solid sludge that can intermix with tobacco pulp and disrupt a sheet casting process. For example, deposits of biofilm on a casting felt surface can inhibit tobacco pulp from being deposited in that location, which can result in perforations in a resulting reconstituted tobacco sheet. Perforations in a reconstituted tobacco sheet can reduce tear resistance, and thus complicate handling of the reconstituted tobacco sheet. Physically removing a biofilm (e.g., by flushing and/or skimming a tank holding a recycled aqueous solution and/or liquid extract) can result in a loss of tobacco solubles, increase an amount of fresh inputs needed, and/or increase the time needed to produce reconstituted tobacco sheets.

In addition to inhibiting and/or controlling biofilm producing bacteria, peroxides can additionally inhibit/control the growth of the entire bacterial population, including bacteria that can form to produce tobacco-specific nitrosamines (TSNAs). In some cases, methods provided herein can include one or more peroxides one or more fluid streams to inhibit the growth of bacteria that produce TSNAs. TSNAs are nitrosation products of secondary and tertiary alkaloid amines in tobacco. TSNAs are the result of a chemical reaction between tobacco alkaloids, such as nicotine and nornicotine, and unstable $NO_x$ radicals (e.g., $NO_2$, $N_2O_3$, and/or $N_2O_4$), which can accumulate as a result of nitrate reduction by bacteria. TSNAs are known in the art and include, for example, N'-nitrosonornicotine (NNN), 4-(methylnitrosoamino)-1-(3-pyridyl)-1-butanone (NNK), N'-nitrosoanatabine (NAT), N'-nitrosoanabasine (NAB), and 4-(methylnitrosoamino)-1-(3-pyridyl)-1-butanal (NNAL). Microbes on or in the tobacco plant before, during, or after curing can be responsible for the formation of nitrite, the predominant $NO_x$ precursor in the formation of TSNAs (Bush et al. *Recent Advances in Tobacco Science*. 27:23-46 (2001)). In some cases, the use of one or more peroxides (e.g., hydrogen peroxide) in a tobacco pulp suspension can reduce a number of bacteria producing unstable $NO_x$ radicals, which can limit a formation of TSNAs in reconstituted tobacco sheets after production. In some cases, reconstituted tobacco sheets provided herein can have less than 50 ppm of TSNAs, less than 25 ppm of TSNAs, less than 20 ppm of TSNAs, or less than 15 ppm of TSNAs.

In some cases, methods provided herein include hydrogen peroxide in one or more fluid streams contacting tobacco pulp in order to limit and/or control a bacterial population within the one or more fluid streams. In some cases, hydrogen peroxide can be separated from tobacco pulp with water by pressing, evaporation, and/or decomposition. Hydrogen peroxide is soluble in water and evaporates at a rate similar to water, thus hydrogen peroxide can be used in fluid streams contacting tobacco pulp without building up a hydrogen peroxide concentration in the tobacco pulp. In some cases, hydrogen peroxide can decompose into oxygen and water due to heat and/or time. In some cases, a heated drying roller can be applied to a reconstituted tobacco sheet including residual hydrogen peroxide to cause the hydrogen peroxide to decompose into oxygen and water. In some cases, a reconstituted tobacco sheet including residual hydrogen peroxide can be stored for a predetermined amount of time in order to reduce a residual hydrogen peroxide concentration below a predetermined limit.

Methods provided herein can improve the quality of reconstituted tobacco sheets, increase the productivity, and/or reduce the costs of producing reconstituted tobacco sheets. In some cases, hydrogen peroxide acts as a processing aid that can control the population of bacteria within recirculated streams such that unwanted bacterial by-products (e.g., biofilm, TSNAs) are minimized. A reduced production of biofilm can increase productivity and reduce cost by avoiding time-consuming and/or product-wasting processes used to physically remove the biofilm. Peroxides can further improve quality by eliminating bacteria that can produce TSNAs. Applicants have also found that the use of hydrogen peroxide in processes described herein does not negatively affect the taste of the reconstituted tobacco sheet.

Unless otherwise defined, all technical and scientific terms used herein have the same meaning as commonly understood by one of ordinary skill in the art to which the methods and compositions of matter belong. Although methods and materials similar or equivalent to those described herein can be used in the practice or testing of the methods and compositions of matter, suitable methods and materials are described below. In addition, the materials, methods, and examples are illustrative only and not intended to be limiting. All publications, patent applications, patents, and other references mentioned herein are incorporated by reference in their entirety.

DETAILED DESCRIPTION

Methods of making reconstituted tobacco provided herein include one or more peroxides (e.g., hydrogen peroxide) in one or more fluid streams contacting tobacco pulp to control and/or reduce a bacterial population in those streams to improve product quality, increase process efficiency, and/or reduce costs. For example, in some processes of making reconstituted tobacco, water and other fluids can be mixed with tobacco by-products in a pulper to create a tobacco pulp suspension. In some cases, liquid (e.g., a liquid including water and tobacco soluble) can be separated from the tobacco pulp, optionally concentrated and/or nitrates removed, and added back to a cast sheet of tobacco pulp. In some cases, tobacco pulp can be processed with a second recycled fluid stream prior to casting a sheet of tobacco pulp. In methods provided herein, fluid streams (such as the water added to the pulper and/or the second recycled fluid stream) can include one or more peroxides to control populations of various bacteria within each fluid stream. In some cases, methods provided herein can control the population of biofilm producing bacteria, such as *Geobacillus stearothermophilus*, and/or TSNA producing bacteria.

Figure 1:
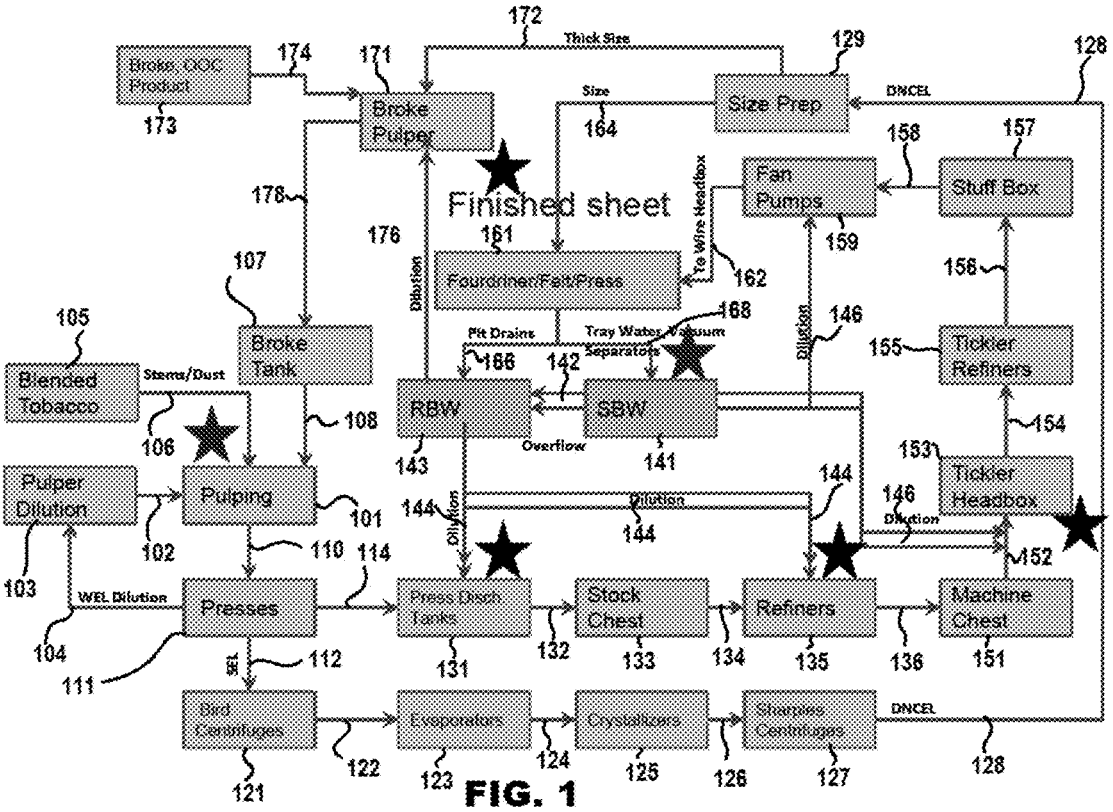
FIG. 1 is a flow chart illustrating an exemplary embodiment of a method of making reconstituted tobacco sheet provided herein.

FIG. 1 is a flow chart illustrating an exemplary embodiment of a method of making reconstituted tobacco sheet provided herein. As shown, pulper dilution 103 and blended tobacco 105 can be mixed via streams 102 and 106, respectively, for pulping 101. Pulping 101 can be conducted in a superpulper, which can rehydrate blended tobacco 105 and form a tobacco pulp suspension. In some cases, blended tobacco 105 can have an average residence time in a superpulper of at least 10 minutes, at least 20 minutes, at least 30 minutes, at least 40 minutes, or at least 50 minutes. In some cases, an average residence time in a superpulper is between 10 minutes and 4 hours, between 20 minutes and 3 hours, between 30 minutes and 2 hours, between 40 minutes and 1 hour, or about 45 minutes. The superpulper can be operated at a temperature of between 20° C. and 100° C., between 30° C. and 90° C., between 40° C. and 75° C., between 50° C. and 65° C., or between 55° C. and 60° C. A tobacco pulp suspension 110 flows to one or more presses 111 to separate liquids 112 from the tobacco pulp 114. In some cases, a stream 104 of liquid from the presses 111 can be cycled back to the pulper dilution 103 tank.

Pulper dilution 103 can be an aqueous solution including one or more peroxides. In some cases, pulper dilution 103 can include hydrogen peroxide and water. In some cases, pulper dilution 103 can consist of water and hydrogen peroxide. In some cases, pulper dilution 103 can include tobacco solubles, flavorants, and other additives. In some cases, a desired concentration of tobacco solubles can be achieved by controlling a recycled flow 104 of liquid from the presses 111. In some cases, pulper dilution can have a peroxide concentration of at least 60 ppm, at least 100 ppm, at least 200 ppm, at least 300 ppm, at least 400 ppm, at least 500 ppm, at least 1,000 ppm, or at least 5,000 ppm. In some cases, the pulper dilution can have a peroxide concentration of less than 10 molar percent, less than 5 molar percent, less than 1 molar percent, less than 5,000 ppm, less than 1,000 ppm, or less than 500 ppm. In some cases, pulper dilution can have a peroxide concentration of between 60 ppm and 10 molar percent, between 100 ppm and 5 molar percent, between 200 ppm and 1 molar percent, between 300 ppm and 5,000 ppm, between 400 ppm and 1,000 ppm, or about 500 ppm. A presence of peroxides in pulper dilution 103 and stream 104 can control populations of bacteria in the dilution streams and any associated holding tank.

Blended tobacco 105 can be any suitable mixture of tobacco and optionally non-tobacco cellulosic materials. By "tobacco" it is meant a part, e.g., leaves, and stems, of a member of the genus *Nicotiana* that has been processed. Exemplary species of tobacco include *N. rustica, N. tabacum, N. tomentosiformis*, and *N. sylvestris*. In some cases, blended tobacco can include tobacco by-products from other tobacco processing operations. For example, tobacco by-products can include tobacco stems, leaf scraps, and tobacco dust produced during the manufacture of cigarettes, cigars, smokeless tobacco, and other tobacco products (i.e., stemming, aging, blending, cutting, drying, cooling, screening, shaping and packaging). In some cases, tobacco can be processed by heat treatment (e.g., cooking, steam treating, toasting), flavoring, enzyme treatment, fermenting, expansion and/or curing. In some cases, the tobacco can be unprocessed tobacco. Specific examples of suitable processed tobaccos include, dark air-cured, dark fire-cured, burley, and flue cured. The tobacco can, in some cases, be prepared from plants having less than 20 μg of DVT per cm2 of green leaf tissue. For example, the tobacco particles can be selected from the tobaccos described in U.S. Patent Publication No. 2008/0209586, which is hereby incorporated by reference. Tobacco compositions containing tobacco from such low-DVT varieties exhibits improved flavor characteristics in sensory panel evaluations when compared to tobacco or tobacco compositions that do not have reduced levels of DVTs.

One or more presses 111 can separate tobacco pulp suspension 110 into a stream of liquid 112 and a mixture of dry and crushed tobacco pulp 114. Liquid 112 can include tobacco extracts, one or more peroxides, and any other soluble additive used in the pulper dilution or present in the blended tobacco. In some cases, this initial extract is referred to as strong extract liquor (SEL). In some cases, the SEL can be further concentrated to form a concentrated extract liquor (CEL) and/or have nitrates removed. As shown, multiple stages 121, 123, 125, and 127 can be used to purify and refine the SEL into de-nitrified concentrated extract liqueur (DNCEL). During production, SEL typically is held in a SEL tank for about 4 hours or less at temperatures that range from 51° C. to 77° C. Conditions in a typical SEL tank include, without limitation, a starting pH of 5.4 and a temperature that ranges from about 51° C. to about 76° C. A typical SEL tank contains about $10^4$ CFU/ml natural microflora, and can have a nitrite content that ranges from about 5 ppm up to about 130 ppm, but processes described herein can reduce the microflora concentration to about or below $10^2$ CFU/ml. During processing, a SEL tank is typically agitated at about 60 RPM to about 75 RPM (e.g., about 65 RPM to about 70 RPM, about 67 RPM). As shown, one or more centrifuges 121 (e.g., bird centrifuges) can be used to separate any remaining solids from the SEL, the remaining liquid 122 passes to any one or more evaporators 123 to remove water to form the CEL 124, which can be passed to one or more crystallizers 125 adapted to crystallize nitrates. CEL 124 can be held in a CEL tank for 0 to 3 hours at temperatures that can range from 20° C. to 50° C. (e.g., 25° C. to 45° C., 30° C. to 40° C., about 35° C.). Crystallizing 125 the CEL produces a Denitrified Extract Liquor (DNCEL) mixed with crystals. An outflow stream 126 from the one or more crystallizers 125 can be passed to one or more centrifuges 127 (e.g., Sharples centrifuges) to remove the crystals to produce the DNCEL 128, which is delivered to a size prep tank 129. DNCEL can be stored in size prep tank 129 for up to 48 hours. The presence of one or more peroxides in this process, due to the use of one or more peroxides in the pulper dilution 103 and/or the pulping process 101, can control the growth of bacteria and thus inhibit the production of TSNAs and/or biofilms in the DNCEL 128. In some case, the peroxide is hydrogen peroxide, which can further be partially removed from the SEL/CEL in the one or more evaporators 123. In some cases, a hydrogen peroxide concentration in DNCEL 128 can be within plus or minus 50% of a hydrogen peroxide concentration in SEL 112. In some cases, a hydrogen peroxide concentration in DNCEL 128 can be within plus or minus 30% of a hydrogen peroxide concentration in SEL 112. In some cases, a hydrogen peroxide concentration in DNCEL 128 can be within plus or minus 10% of a hydrogen peroxide concentration in SEL 112. In size prep 129, a thick size fraction 172 is removed and directed to a broke pulper 171, combined with diluent 176 from tank 143 and broke, OOC product 173 from flow 174, and directed in flow 178 to a broke tank 107, which is stored for delivery to pulping process 101. The broke tank 107 can store product for startup processes or when a supply of blended tobacco 105 is not available.

Dry and crushed tobacco pulp 114 can be further processed and cast into a sheet. As shown, tobacco pulp 114 is delivered through a series of press and discharge tanks where it is mixed and separated from recycled dilution before being cast into a sheet in casting process 161. As shown, tobacco pulp 114 is mixed with dilution 144 from a tank 143 in one or more press discharge tanks 131 to make slurry 132, which is delivered to a stock chest 133. Output 134 from stock chest 133 is delivered to one or more refiners 135 for further mixing with dilution 144 from tank 143. Output 136 from refiners 135 is delivered to a machine chest 151, and a machine chest output 152 is mixed with additional dilution 146 from a tank 141 and delivered to a tickler headbox 153. Output 154 from tickler headbox 53 is delivered to one or more tickler refiners 155. Output 156 from the tickler refiners 155 is delivered to a stuff box 157. Output 158 from stuff box 157 is delivered to fan pumps 159 where additional dilution 146 is added from tank 141. Slurry 162 from fan pumps 159 is then delivered to a fourdrainer felt press 161 where a sheet of tobacco pulp is cast. Size 164 from size prep 129 is also sprayed onto the cast tobacco pulp sheet in fourdrainer felt press 161 to add back tobacco solubles. A cast sheet of tobacco pulp is then dried to form a reconstituted tobacco sheet. Pit drains 166 of fourdrainer felt press 161 recycle diluent back to tank 143. Tray Water and Vaccum separators 168 of fourdrainer felt press 161 recycle diluent back to tank 141, with overflow 142 from Strong Brown Water tank being delivered to the tank 143. Accordingly, diluent mixed with tobacco pulp 114 during the various processing steps is subsequently separated from the tobacco pulp during the casting of a sheet of tobacco pulp and recycled back to a storage tank.

Recycling diluent 144, 146, 166, and 168 results in the diluent collecting tobacco soluble and other additives. Fresh water and/or peroxides (e.g., hydrogen peroxide) can be added to tank 141 or tank 143 during the process to make up for water losses and/or to control a peroxide concentration. A peroxide concentration in the diluent in tank 141 or tank 143 can be maintained at a predetermined concentration. In some cases, a peroxide concentration in tank 141 and/or tank 143 is maintained at a level of at least 60 ppm, at least 100 ppm, at least 200 ppm, at least 300 ppm, at least 400 ppm, at least 500 ppm, at least 1,000 ppm, or at least 5,000 ppm.

In some cases, tank 141 and/or tank 143 are maintained at a temperature of between 60° C. and 73° C. In some cases, a peroxide concentration in tank 141 and/or tank 143 is maintained at a level of less than 10 molar percent, less than 5 molar percent, less than 1 molar percent, less than 5,000 ppm, less than 1,000 ppm, or less than 500 ppm. In some cases, a peroxide concentration in tank 141 and/or tank 143 is maintained at a level of between 60 ppm and 10 molar percent, between 100 ppm and 5 molar percent, between 200 ppm and 1 molar percent, between 300 ppm and 5,000 ppm, between 400 ppm and 1,000 ppm, or about 500 ppm. A presence of peroxides in tank 141 and/or tank 143 and throughout the various processing of the tobacco pulp can control populations of bacteria in tank 141 and/or tank 143. Controlling bacteria in the tank 141, tank 143, Pulping 101, and other parts of the process can be important because bacteria can produce biofilms and/or produce TSNAs.

Figure 2:
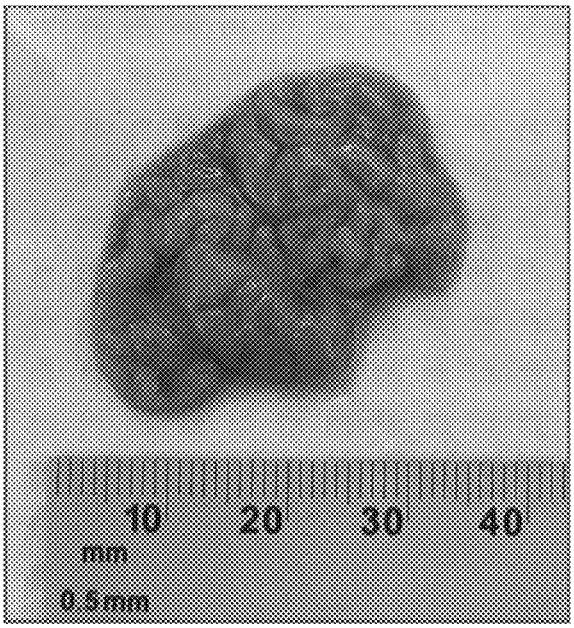
FIG. 2 depicts a biofilm or sludge produced by *Geobacillus stearothermophilus.*

In some cases, methods provided herein can inhibit the growth of biofilm producing bacteria, such as *Geobacillus stearothermophilus*, in the tank 141, tank 143, Pulping 101, and other parts of the process. *Geobacillus stearothermophilus* can produce a biofilm or sludge, such as that depicted in FIG. 2. Biofilm sludge, such as shown in FIG. 2, can become intermixed with tobacco pulp 114 during pulping 101, during mixture with diluent 144 and 146, and disrupt a sheet casting process 161. For example, deposits of biofilm on a casting felt surface 161 can inhibit tobacco pulp from being deposited in that location, which can result in perforations in a resulting reconstituted tobacco sheet. Perforations in a reconstituted tobacco sheet can reduce tear resistance, and thus complicate handling of the reconstituted tobacco sheet. Physically removing a biofilm (e.g., by flushing and/or skimming tank 141 and/or tank 143) can result in a loss of tobacco soluble, increase an amount of fresh inputs needed, and/or increase the time needed to produce reconstituted tobacco sheets.

In addition to inhibiting and/or controlling biofilm producing bacteria, peroxides can additionally inhibit/control the growth of the entire bacterial population, including bacteria that can form to produce TSNAs. In some cases, methods provided herein can include one or more peroxides in one or more fluid streams to inhibit the growth of bacteria that produce TSNAs. TSNAs are nitrosation products of secondary and tertiary alkaloid amines in tobacco. TSNAs are the result of a chemical reaction between tobacco alkaloids, such as nicotine and nornicotine, and unstable $NO_x$ radicals (e.g., $NO_2$, $N_2O_3$, and/or $N_2O_4$), which can accumulate as a result of nitrate reduction by bacteria. TSNAs are known in the art and include, for example, N'-nitrosonornicotine (NNN), 4-(methylnitrosoamino)-1-(3-pyridyl)-1-butanone (NNK), N'-nitrosoanatabine (NAT), N'-nitrosoanabasine (NAB), and 4-(methylnitrosoamino)-1-(3-pyridyl)-1-butanal (NNAL). Microbes on or in the tobacco plant before, during, or after curing can be responsible for the formation of nitrite, the predominant $NO_x$ precursor in the formation of TSNAs (Bush et al. *Recent Advances in Tobacco Science*. 27:23-46 (2001)). In some cases, the use of one or more peroxides (e.g., hydrogen peroxide) in a tobacco pulp suspension can reduce a number of bacteria producing unstable $NO_x$ radicals, which can limit a formation of TSNAs in reconstituted tobacco sheets after production.

In some cases, methods provided herein include hydrogen peroxide in one or more fluid streams contacting tobacco pulp in order limit and/or control a bacterial population within tank 141 and/or tank 143. In some cases, hydrogen peroxide can be separated from tobacco pulp with water by pressing, evaporation, and/or decomposition. Hydrogen peroxide is soluble in water and evaporates at a rate similar to water, thus hydrogen peroxide can be used in fluid streams contacting tobacco pulp without building up a hydrogen peroxide concentration in the tobacco pulp. In some cases, hydrogen peroxide can decompose into oxygen and water due to heat and/or time. In some cases, a heated drying roller can be applied to a reconstituted tobacco sheet including residual hydrogen peroxide to cause the hydrogen peroxide to decompose into oxygen and water. In some cases, a reconstituted tobacco sheet including residual hydrogen peroxide can be stored for a predetermined amount of time in order to reduce a residual hydrogen peroxide concentration below a predetermined limit.

OTHER EMBODIMENTS

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

What is claimed is:

1. A method of making reconstituted tobacco comprising:
producing a tobacco pulp suspension by agitating tobacco by-products with an aqueous pulping fluid;
contacting a mixture including tobacco pulp with one or more fluid streams including one or more peroxides, at least one of said one or more fluid streams comprising the aqueous pulping fluid;
recovering at least one recovered fluid from the mixture, the at least one recovered fluid comprising one or more peroxides; and
contacting tobacco pulp with the at least one recovered fluid.

2. The method of claim 1, further comprising separating said tobacco pulp suspension into a tobacco pulp mixture and a liquid extract, the liquid extract comprising one or more peroxides.

3. The method of claim 2, further comprising introducing the liquid extract to a cast sheet comprising tobacco pulp.

4. The method of claim 3, further comprising concentrating the liquid extract prior to introducing the liquid extract to the cast sheet.

5. The method of claim 3, further comprising removing nitrates from said liquid extract prior to introducing the liquid extract to the cast sheet.

6. The method of claim 3, further comprising drying said cast sheet comprising said tobacco pulp and said liquid extract.

7. The method of claim 2, further comprising contacting said tobacco pulp mixture with a second fluid stream, said second fluid stream comprising one or more peroxides.

8. The method of claim 1, wherein the one or more peroxides comprise hydrogen peroxide.

9. The method of claim 1, wherein said aqueous pulping fluid comprises between 60 ppm and 5,000 ppm hydrogen peroxide.

* * * * *